US005224920A

United States Patent [19]

Janssen et al.

[11] Patent Number: 5,224,920

[45] Date of Patent: Jul. 6, 1993

[54] DEVICE FOR FOLDING AND COLLECTING SHEETS OF DIFFERENT FORMATS

[75] Inventors: Willem P. H. A. Janssen; Floris J. Marcellis, both of Venlo, Netherlands

[73] Assignee: OCE-Nederland B.V., Venlo, Netherlands

[21] Appl. No.: 740,919

[22] Filed: Aug. 6, 1991

[30] Foreign Application Priority Data

Aug. 10, 1990 [NL] Netherlands ..... 9001798

[51] Int. Cl.[5] ..... B65H 45/04

[52] U.S. Cl. ..... 493/417; 493/23; 493/25

[58] Field of Search ..... 493/8, 10-11, 493/13-15, 17-18, 23, 25, 419-421, 417

[56] References Cited

U.S. PATENT DOCUMENTS

| | | | |
|---|---|---|---|
| 1,684,803 | 9/1928 | Olson et al. | 493/419 |
| 1,725,837 | 8/1929 | Spiess | 493/419 |
| 1,831,246 | 11/1931 | Hitchcock | 493/421 X |
| 3,698,705 | 10/1972 | Funk et al. | 493/23 X |
| 3,831,927 | 8/1974 | Van Herten | 493/416 |
| 3,961,781 | 6/1976 | Funk . | |
| 4,701,155 | 10/1987 | Ott . | |
| 5,045,039 | 9/1991 | Bay | 493/419 X |
| 5,120,290 | 6/1992 | Bay | 493/14 |

FOREIGN PATENT DOCUMENTS

| | | |
|---|---|---|
| 6909319 | 12/1969 | Netherlands . |
| 1394480 | 5/1975 | United Kingdom . |

OTHER PUBLICATIONS

"Junior Jets", Baumfolders Catalog, Bell and Howell Company, Mar. 1964.

"Mark I Series", Baumfolders Catalog, Bell and Howell Company, Mar. 1964.

*Primary Examiner*—Bruce M. Kisliuk
*Assistant Examiner*—John A. Marlott
*Attorney, Agent, or Firm*—Birch, Stewart, Kolasch & Birch

[57] ABSTRACT

A folding and depositing device for drawings provided with legends, comprising two folding stations for folding drawings in two directions at right angles to one another and a collecting station for depositing the folded drawings with their legends on the same side such that the folding stations fold drawings of a first group of formats (A1 and A2), first in the longitudinal direction and then in the transverse direction, and fold drawings of a second group of formats (A0 and A3), first in the transverse direction and then in the longitudinal direction and, depending on the group to which they belong, the folded drawings are directed via different discharge paths from the second folding station to the collecting station, and wherein an intermediate transport path between the folding stations is accessible via a routing switch to enable a subsequent drawing to be folded in the first folding station while a previous drawing is being transversely transported to the second folding station.

9 Claims, 6 Drawing Sheets

DEVICE FOR FOLDING AND COLLECTING SHEETS OF DIFFERENT FORMATS

BACKGROUND OF THE INVENTION

1. Field of the Invention

The present invention relates to a sheet folding configuration, and more specifically, to a device for folding sheets having different formats and depositing the sheets in folded form.

2. Discussion of the Related Art

A device of the kind herein under consideration is disclosed in U.S. Pat. No. 4,701,155, wherein there is described a mechanism for folding sheets of drawings in the various formats A1, A2 or A3, which drawings are conventionally provided with a legend at the bottom right-hand corner. Sheets of drawings are fed in the feed path of this known device with an orientation such that the drawing, and hence also the legend, is legible when viewed from a specific side of the feed path. Looking in the direction of the feed, the legend is positioned at the left-hand side of the trailing part of the sheet fed in the longitudinal direction. At the first folding station an A1 sheet is folded four times in the transverse direction, and A2 and A3 sheets are folded twice. The packet thus folded in zig-zag fashion is then fed to the second folding station with the legend situated at the top. At the second folding station the zig-zag folded A1 and A2 sheets are double-folded and the zig-zag folded A3 sheet is passed on without any further folding. The sheets folded in this manner are then deposited in a collecting station in a uniform way, i.e. with the legends at the top.

One of the features of this known device is that in order to ensure that the folded sheets of drawings are deposited with their legends on the same side, the sheets must always be fed with their longest side parallel to the feed direction, and this is hereinafter referred to as a longitudinal transit. Since, in the case of the longitudinal transit, the processing capacity of the device is inversely proportional to the length of the longest side of a sheet of drawings, the known device has the disadvantage that the processing capacity is adversely affected in order to achieve the above uniform deposition.

SUMMARY OF THE INVENTION

Therefore, it is an object of the present invention to provide a folding device for copy sheets of varying formats which will overcome the above-noted disadvantages.

It is a further object of the invention to provide a copy sheet folding device which has optimal processing capacity, but also guarantees a uniform deposition of the folded sheets.

Still a further object of the present invention is to provide a device for folding copying sheets of different formats maintaining a uniform deposition of the folded sheets.

The foregoing objects and others are accomplished in accordance with the present invention, generally speaking, by providing a device comprising a first folding station for folding a sheet in a first direction an even number of times, a second folding station for folding the same sheet in a second direction at right angles to the first direction, a collecting station for collecting sheets folded by the device, a feed path for feeding a sheet to the first folding station, an intermediate transport path for conveying a sheet from the first folding station to the second folding station and a discharge path for discharging a sheet from the second folding station to the collecting station, the discharge path having a first portion for depositing in a first orientation a folded sheet belonging to a first group, and a second portion for depositing in a second orientation a folded sheet belonging to a second group, such that the orientations of the folded sheets are deposited in a turned-over form with respect to one another. As a result, it is possible on the one hand to fold and uniformly deposit sheets whose longest side is of a dimension larger than the working width of the device, i.e. the width of the feed path, these sheets belonging to the first group, while on the other hand optimal processing capacity is obtained for folding in two directions and uniformly depositing sheets whose longest side is of a dimension equal to or smaller than the working width of the device, these sheets belonging to the second group.

In one embodiment of a device according to the present invention, a detection means is provided which detects the format and orientation of a sheet fed in the feed path and, on the basis thereof, detects whether the sheet belongs to the first group or the second group and control means is provided which, in response to the detection by the detection means, activates a first transport means for feeding into the first portion of the discharge path a sheet belonging to the first group or activate a second transport means for feeding into the second portion of the discharge path a sheet belonging to the second group. As a result, the device can be automatically adjusted to obtain optimal folding and sheet discharging, resulting in rapid processing and uniform deposition of the sheets. Preferably, the detection means classify a sheet whose shortest side is equal to or shorter than the maximum distance between two folds that the second folding station can apply, in the same group as a sheet whose longest side is longer than the length of the first folding station in the second direction. Thus, a sheet in the A3 format provided with a legend is folded only in the first folding station so that the folded sheet has a free edge extending on a side of the folded packet situated opposite the corner of the sheet where the legend is situated, this sheet edge being usable as a binding edge so that the folded sheet can be unfolded in the bound condition.

According to another aspect of the invention, the above objects are achieved in a device according to the invention in which the first folding station is of the type in which a sheet is folded by two pairs of folding rollers with nips provided in one folding plane, in that the intermediate transport path comprises a first path portion and a second path portion, both adjoining the folding plane on the same side of the first folding station, the second path portion being provided with a transport means for conveying a sheet to the second folding station, in that the intermediate transport path is provided with a guide element which can occupy two positions, a first position in which it leads a sheet from the first folding station into the first path portion and a second position wherein it leads a sheet from the first folding station into the second path portion, and wherein control means are provided which can set the guide element only into the second position during the application of the last fold in the first folding station and set the guide element in the first position during the application of the other folds in the first folding station.

Consequently, the first folding station can start folding a subsequent sheet while the preceding sheet is still situated in the intermediate transport path.

DETAILED DESCRIPTION OF THE INVENTION

Characteristics and advantages of the invention are explained by reference to the following description of the present invention with reference to the drawings wherein:

FIG. 1 is a diagrammatic perspective view of a first embodiment of a device according to the invention;

FIG. 1*a* is a diagram of a variant of a part of the device shown in FIG. 1;

Figure 1:
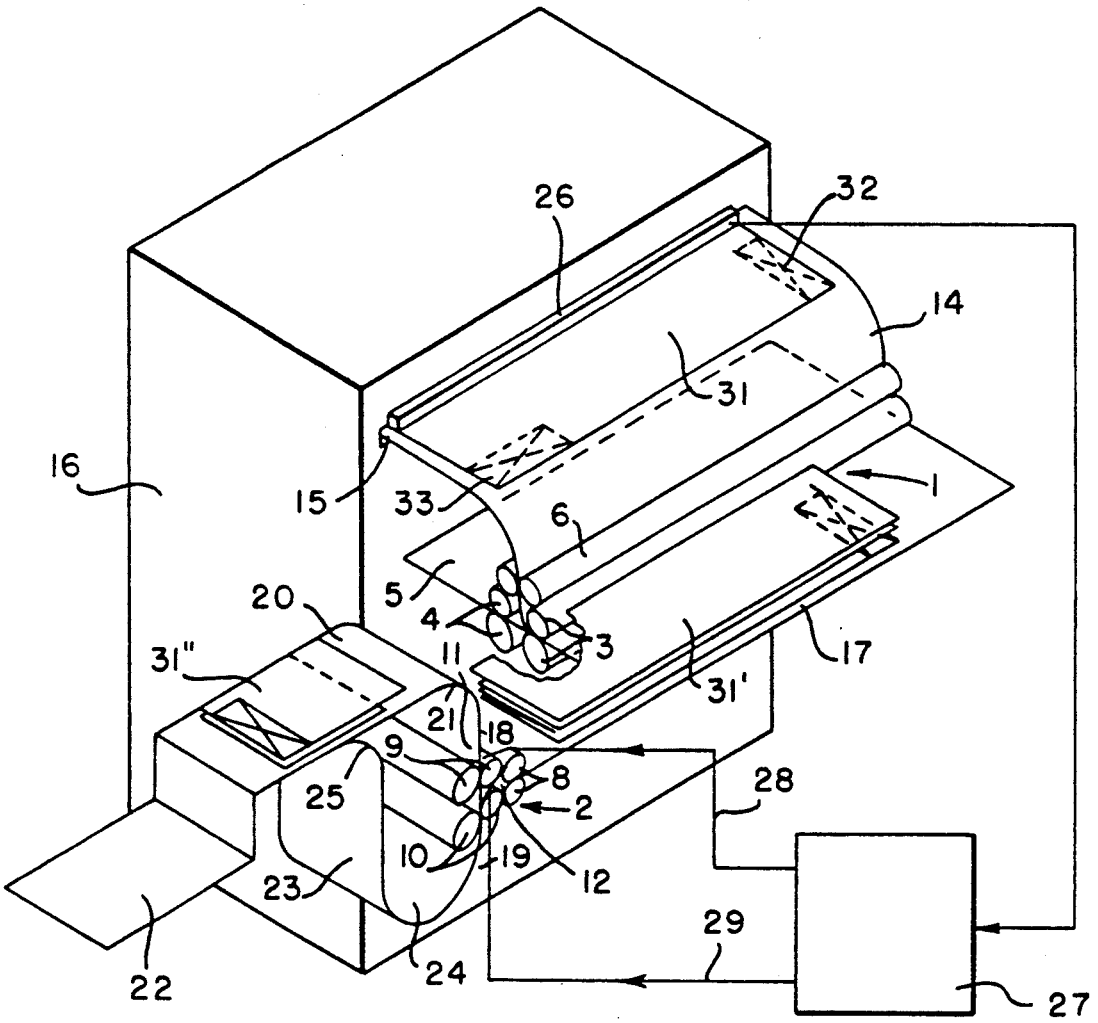
Figure 2:
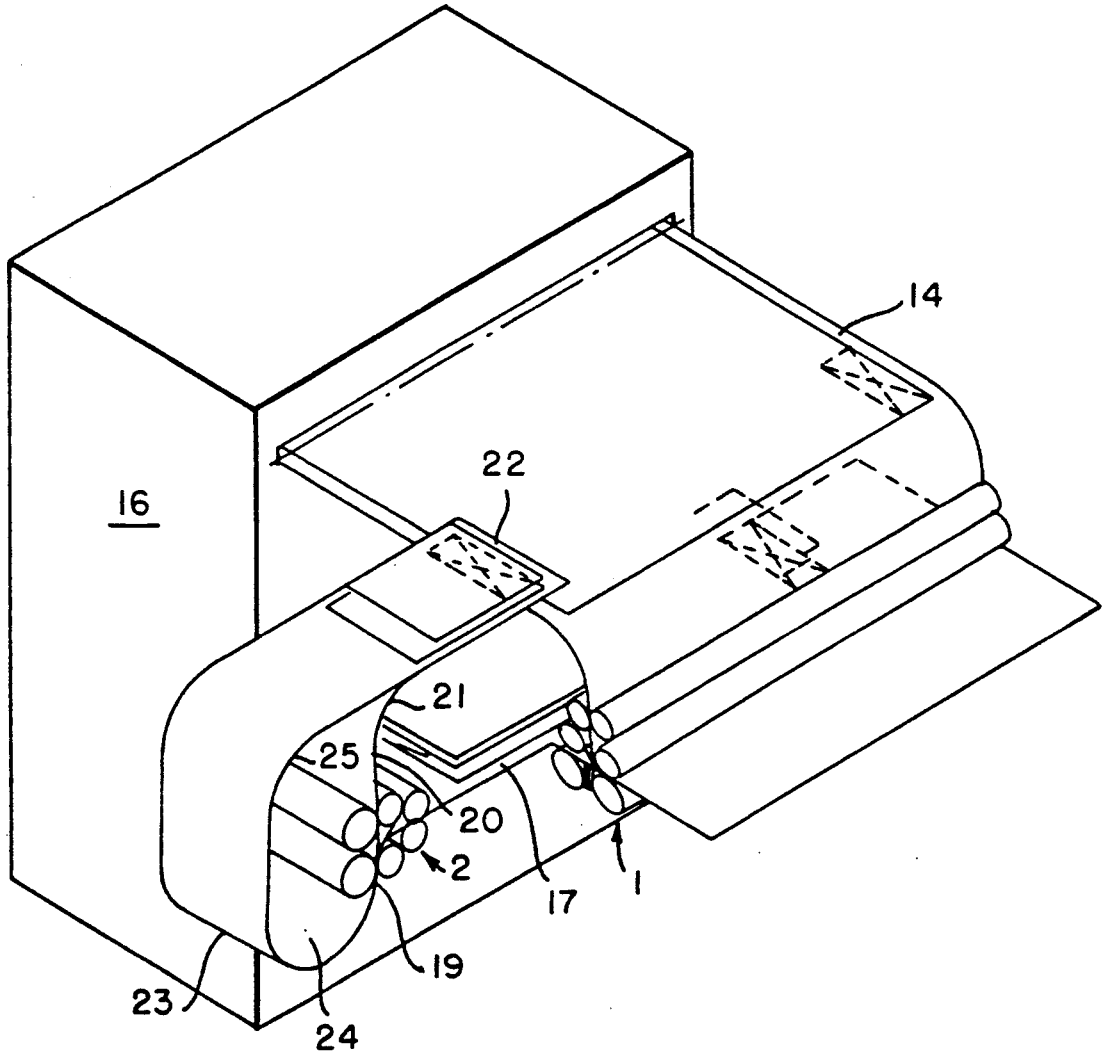
FIG. 2 is a diagrammatic perspective view of a second embodiment of a device according to the invention.
Figure 3:
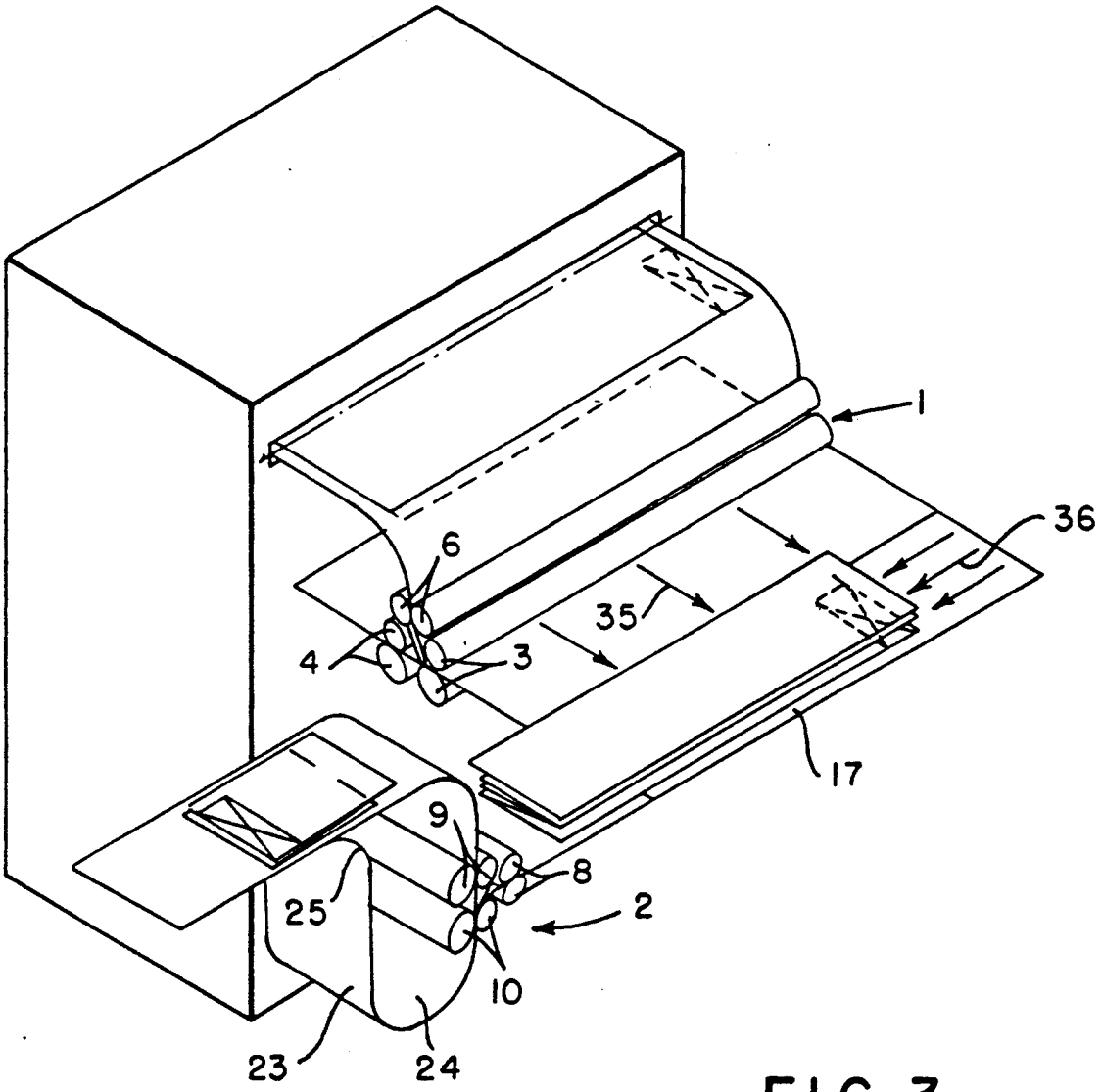
FIG. 3 is a diagrammatic perspective view of a third embodiment of a device according to the invention.

The device shown in FIGS. 1, 2 and 3 each comprise a folding station 1 for the zig-zag folding of a still unfolded sheet and folding station 2 for the zig-zag folding of the sheet folded in folding station 1, the zig-zag folding in station 2 being in a direction extending transversely of the direction in which the sheet was folded in folding station 1. The folding stations 1 and 2 are both of the type shown in U.S. Pat. No. 3,831,927. Folding station 1 comprises pairs of folding roller 3 and 4 which form transport and folding nips situated at some distance from one another in a common folding plane 5, the directions of rotation of the folding rollers 3 and 4 being reversible. A pair of input rollers 6 forms a transport nip in a plane at a right angle to the folding plane 5 and intersecting the folding plane 5 between the folding nips of the folding rollers 3 and 4. A funnel-shaped guide member 7 is disposed in a zone between the input rollers 6 and the folding rollers 3 and 4 and is displaceable between a position in which a sheet conveyed by the input rollers 6 is guided in the direction of folding rollers 3 and a position in which a sheet conveyed by input rollers 6 is guided in the direction of folding rollers 4. To form a fold in a sheet fed between the pair of input rollers 6 and one of the pairs of folding rollers 3 or 4, the direction of rotation of the folding rollers is reversed and the guide member 7 is moved to the position in which the sheet is guided to the other pair of folding rollers 4 or 3. As a result, a blouse is formed in the sheet beneath the guide member 7. When this blouse is engaged by the other pair of folding rollers 4 or 3, a fold forms in the sheet at that place. By moving the guide member 7 back again and reversing the direction of rotation of the folding rollers 3 and 4, given continuous sheet feed, a second fold is formed in the sheet in opposition to the first fold. In this way the sheet can be folded zig-zag. The reciprocating movement of the guide member 7 and the direction of rotation of the folding rollers 3 and 4 can be controlled in the manner explained in the above-mentioned U.S. Pat. No. 3,831,927, which explanation is herein incorporated by reference. Folding station 2 is of the same type as folding station 1 and comprises input rollers 8 for inputting a sheet fed through from folding station 1, and pairs of folding rollers 9 and 10 whose nips are situated in a folding plane 11, and a funnel-shaped guide member 12.

In the devices shown in FIGS. 1, 2 and 3, folding plane 5 extends horizontally and folding plane 11 vertically. It is of course possible for these folding planes to extend in other directions. It is also possible to use a different type of folding device in the folding stations and 2 from that described above.

Sheets are fed to folding station 1 via a feed path 14 leading into the nip between the input rollers 6. Feed path 14 can be connected to the output 15 of a sheet printing device 16, e.g. a copying machine, only the contours of which are shown. Sheets fed through folding station 1 are fed to folding station 2 via an intermediate transport path 17 which extends in the folding plane 5 and which is provided with transport means (not shown) which feeds a sheet from folding station 1 first in a direction at right angles to the longitudinal direction of the folding rollers 3 and 4 of folding station 1, and then feeds the sheet in a direction parallel to the longitudinal direction of the folding rollers of folding station 1, for feeding the sheet into folding station 2.

Sheets fed through folding station 2 can be fed out of folding station 2 by a conveyor means (not shown) in the vertical folding plane or transport path 11, via a top outlet 18 or via a bottom outlet 19. That part 20 of the discharge path which extends from the top outlet 18 of folding station 2 is provided with a bend 21 which extends over 90° and leads into a collecting station 22 in which the sheets fed through folding stations 1 and 2 are deposited on one another. That part 2 of the discharge path which extends from the bottom outlet 19 of folding station 2 is provided with a bend 24 which extends over 180° and a bend 25 which extends over 90° and leads out in the same way into the collecting station 22 as the part 20 of the discharge path.

As seen in FIG. 1, a sheet detection device 26 is disposed in feed path 14 and consists of an array of sheet detectors covering the entire width of the feed path 14. The number of detectors that a supplied sheet sees is a measurement of the width of the supplied sheet and the interval of time in which the number of detectors see the sheet is a measurement of the length of the sheet. Signals generated by the detection device 26 enable the control device 27 to determine the format and orientation of the supplied sheet. On the basis of the measured length the control device 27 establishes a folding program to be performed at folding station 1, e.g. zig-zag folding of a sheet in accordance with a folding pattern as shown in U.S. Pat. No. 3,831,927. Detection device 26 is disposed at a distance upstream of the folding station 1 such that the folding program to be performed by folding station 1 can be performed in good time.

For the performance of the folding program at folding station 1, the leading edge of the supplied sheet is first directed by the member 7 between the folding rollers 3. The folding rollers 3 also apply the last fold. On the basis of the measured sheet width the control device 27 determines the folding program for folding station 2. In the performance of the latter folding program, a sheet which is not to be folded or which is to be folded twice in the folding station 2, is first fed by guide member 12 between folding roller 10, while a sheet which is to be folded once in folding station 2 is first fed between the folding rollers 9 by the guide member 12 set to the alternate position.

For sheet formats A0 to A4 inclusive, the folding program to be executed by folding station 2 consists of transverse folding twice of an A0 sheet already folded zig-zag in the longitudinal direction at folding station 1, transverse folding twice of an A1 sheet already folded zig-zag in the longitudinal direction at folding station 1, transverse folding once of an A2 sheet already folded zig-zag in the longitudinal direction at folding station 1, non-folding of an A3 sheet already transversely folded zig-zag at folding station 1, and non-folding of an A4 sheet again not folded at folding station 1.

On the basis of the orientation in which a sheet of a specific format to be folded is fed, either longitudinally or transversely, the control device 27 determines the folding program applicable to that sheet. A sheet of a width corresponding to the working width of folding station 1 and longer than the width, e.g. an A0 sheet fed in the longitudinal direction, is classified in a first group by the control device 27. A sheet narrower than the distance between two folds which folding station 2 can apply, e.g. a longitudinally supplied A3 sheet, is also classified in the first group by control device 27. A sheet whose dimensions correspond to a format having the same dimensions as or smaller than the dimensions of a sheet folded in the device, e.g. an A4 sheet supplied in the transverse direction, is also classified in the first group.

Sheets having dimensions between the above maximum format (A0) and the above smallest formats (A3, A4) are supplied transversely according to the invention, something which can be checked by the detection device 26. This latter group of sheets is classified in a second group by the control device 27.

When a sheet supplied is classified in the first group, the control device 27 generates a control signal 28 which, after completion of the folding program to be performed by folding station 2, activates folding rollers 9 in order to deposit the sheet in the collecting station 22 via part 20 of the discharge path.

If a sheet supplied is classified in the second group, control device 27 generates a control signal 29 which, after completion of the folding program to be performed by folding station 2, activates folding rollers 10 in order to deposit the sheet in collecting station 22 via part 23 of the discharge path.

The operation of the device shown in FIG. 1 for sheets of drawings in the formats A0 to A4 inclusive, provided with a legend in the bottom right-hand corner, will be explained below. This explanation is based on the supply of a drawing 31 with the drawing side facing down and with the legend at the leading edge of the drawing. In the case of an A0 sheet, this legend is situated at the location denoted by 32 while in the case of an A1 sheet it is situated at the location denoted by 33. An A0 sheet fed in the longitudinal direction is folded six times in folding station 1, then fed out of folding station 1 by folding rollers 3 and brought into the position indicated by reference 31', from which position the zig-zag folded sheet is fed between input rollers 8 of folding station 2 by means of intermediate conveying means (not shown). At the folding station 2 the sheet is fed by a guide member 12 with its leading edge between the folding rollers 10. After two transverse folds have been made by successive pairs of folding rollers 9 and 10, the folded sheet is fed by folding rollers 9 into part 20 of the discharge path, where it reaches position 31" and from there to collecting station 22.

An A1 sheet fed in the transverse direction is folded twice at the folding station 1 and the package folded in this way is first fed by guide member 12 of folding station 2 between folding rollers 9 and, after transverse folds have been applied by successive pairs of folding rollers 10 and 9, is fed by folding rollers 10 into part 23 of the discharge path and from there to the collecting station 22 where the folded A1 sheet comes to lie with its legend also facing up.

An A2 sheet fed in the transverse direction is folded twice in the folding station 1 and is first fed between folding rollers 9 in folding station 2, then double-folded between folding rollers 10 and then fed by the folding roller pair 10 into part 23 of the discharge path and from there to the collecting station 22 where the folded A2 sheet again lands with its legend facing upwards.

An A3 sheet fed in the longitudinal direction is only folded twice in folding station 1 and is then fed, via the intermediate transport path 17, by input rollers 8 and guide member 12 between folding rollers 10 and then, by reversal of the direction of rotation of the pairs of rollers 9 and 10, to part 20 of the discharge path and from there to the collecting station 22 where the folded A3 sheet is discharged with its legend face up.

An A4 sheet fed in the transverse direction is fed without being folded directly by guide member 7 and folding roller pair 3 through folding station 1 and, in the same way as an A3 sheet, through folding station 2, so that the A4 sheet like the other drawings formats comes to lie with its legend face up in the collecting station 22.

Figure 1A:
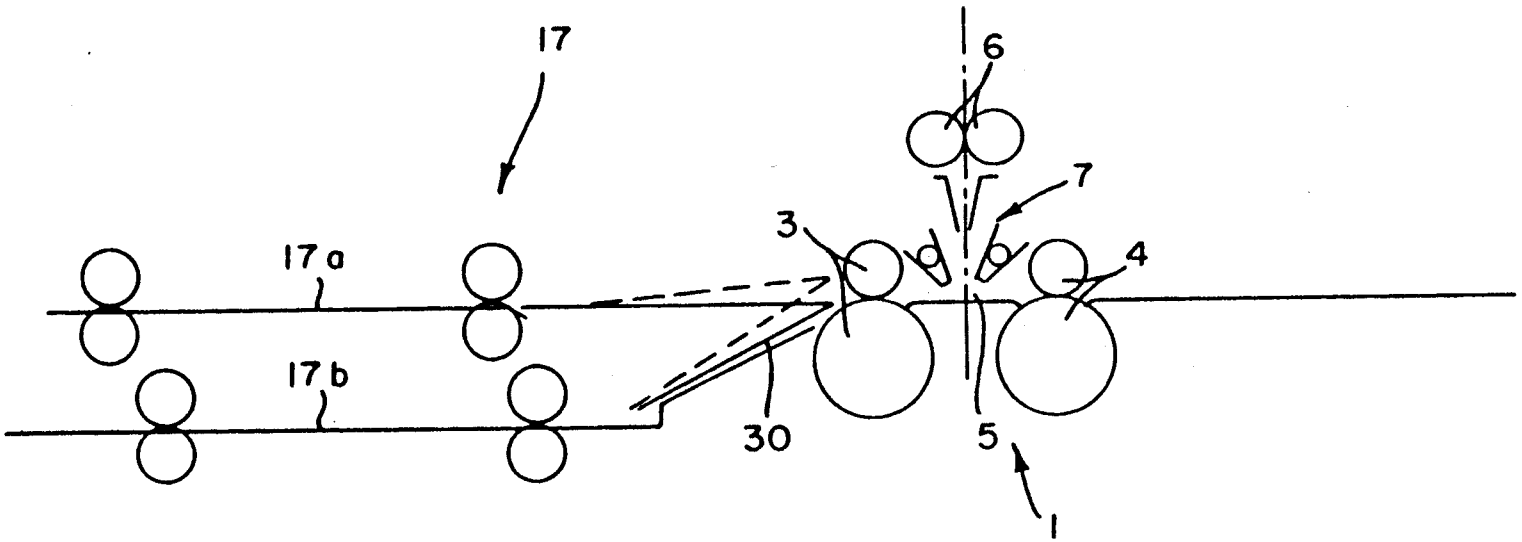

FIG. 1*a* which illustrates the folding station 1 and intermediate transport 17 is an alternate embodiment of the intermediate transport 17 shown in FIG. 1.

In this embodiment, the intermediate transport 17 comprises a path portion 17*a* in the same plane as the folding plane 5 and a path portion 17*b* beneath path portion 17*a*. A guide element 30 is disposed between folding station 1 and the intermediate transport 17. Guide element 30 can be set by control device 27 to a solid-line position in order to lead a sheet out of folding station 1 via path portion 17*a*, and to a broken-line position to lead a sheet out of folding station 1 via path portion 17*b*.

The operation of the intermediate transport shown in FIG. 1*a* is as follows:

Upon feeding a sheet to be folded in folding station 1, the guide element 30 is in the solid-line position. The leading edge of the sheet is fed into path portion 17*a* by folding rollers 3. The sheet is then fed back and forth in folding plane 5, folds being applied by folding rollers 3 and 4. Just before the last fold is to be applied, the part of the sheet which has already been folded is largely on the side of folding station 1 remote from path portion 17*a*. At that moment, control device 27 delivers a signal in response to which the guide element 30 is moved into the broken-line position. After the last fold has been applied, folding rollers 3 then feed the zig-zag folded sheet into path portion 17*b* of the intermediate transport 17. Directly after the trailing edge of the zig-zag folded sheet passes the guide element 30, the control device 27 resets the guide element 30 to the solid-line position. Path portion 17*b* is provided with transport means (not shown) which feeds the zig-zag folded sheet fed from folding station 1 transversely to the folding station 2. While the sheet is being moved out of the intermediate transport 17 in the transverse direction, a subsequent sheet can already be fed by its leading edge into the intermediate transport 17, and specifically into portion 17*a* thereof. Thus sheets can be folded in a rapid sequence. Path portion 17*a* can also act as a discharge path for a sheet not requiring to be folded in folding station 2.

The device shown in FIG. 2 differs from the device shown in FIG. 1 in that the bends 21 and 25 in the portions 20 and 23 of the discharge path are bent in the opposite direction so that folded sheets, unlike the above-described operation of the device according to FIG. 1, come to lie in the collecting tray with their legends face down. The advantage of this is that folded drawings fed to the folding device in a specific sequence with the drawing side face down can be deposited in the same sequence in the collecting station with their legends face up.

The device shown in FIG. 2 also differs from the device shown in FIG. 1 in that the intermediate transport 17 between the folding station 1 and 2 is on the other side of folding station 1, with the result that collecting station 22 is closer to the start of the feed path 14 and hence closer to the connected sheet-processing machine 16.

The alternate embodiment shown in FIG. 3 differs from the device shown in FIG. 1 in that in the intermediate transport 17 of sheets between folding stations 1 and 2 the sheet folded in one direction is first conveyed in the direction indicated by arrows 35, at right angles to the longitudinal direction of the folding rollers 4 and 3 over a distance past the folding roller 3 greater than the maximum width of the package comprising the zig-zag folded sheet and only then is fed to folding station 2 in the direction indicated by arrows 36, at right angles to the directed indicated by arrows 35. As a result folding station 1 can start folding a subsequent sheet during the intermediate transport of a sheet, unlike the configuration described with reference to FIG. 1*a*, so that sheets to be folded can be fed into the folding device at very rapid intervals.

Figure 4:
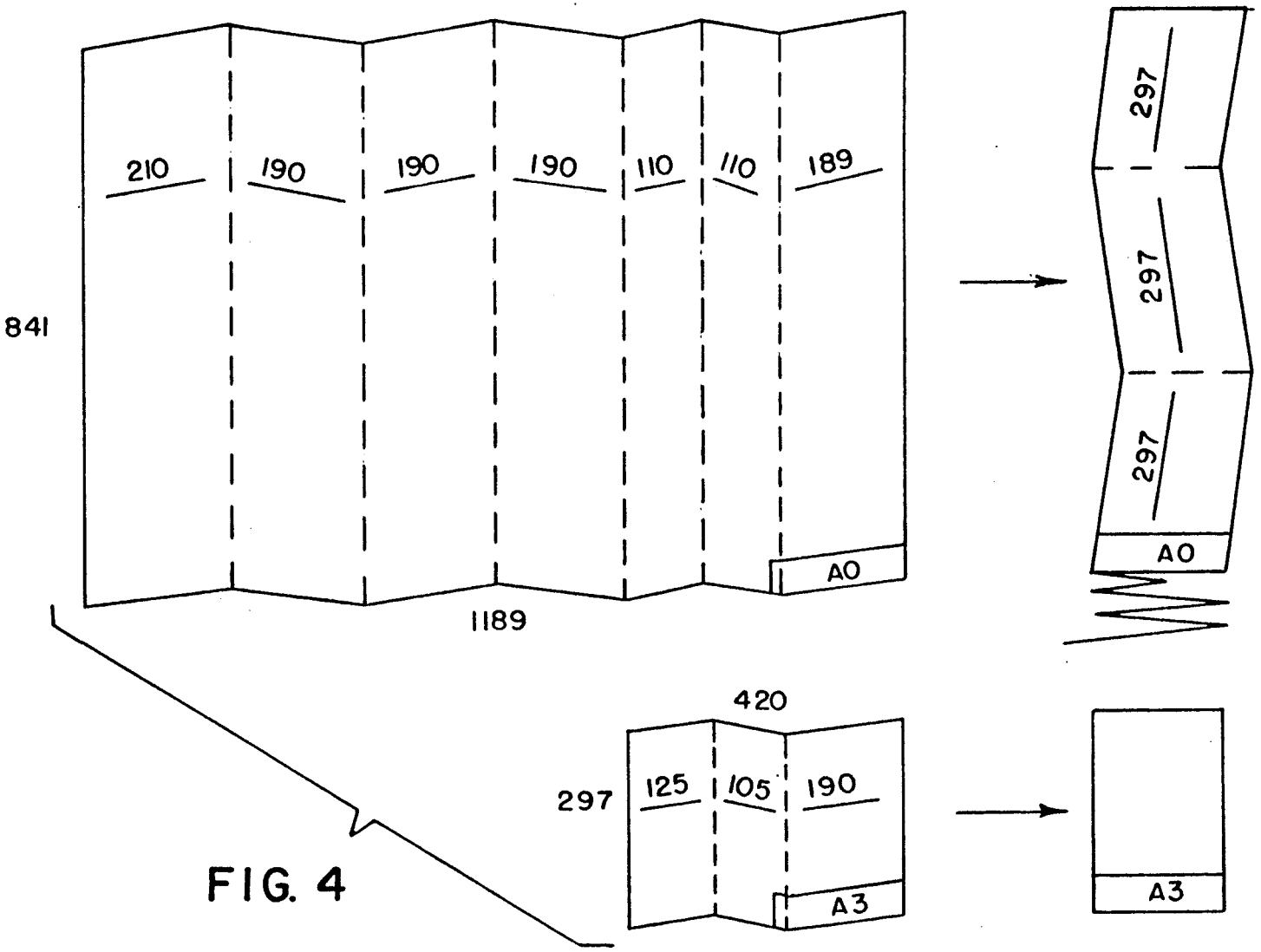
FIG. 4 shows the folding pattern applied by a device according to FIGS. 1 to 3 to a sheet of drawings of the format A0 and A3.
Figure 5:
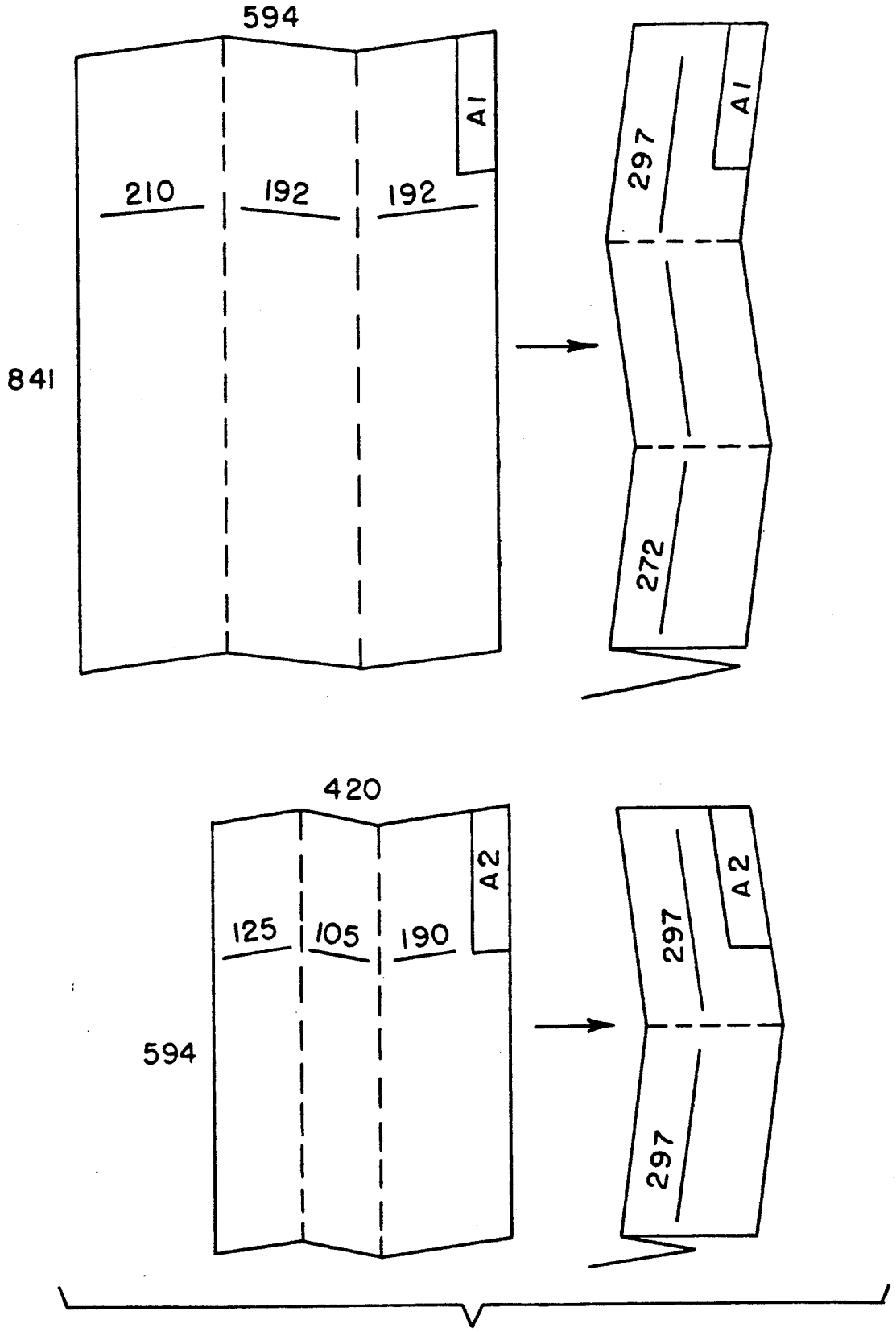
FIG. 5 shows the folding pattern applied by a device according to one of FIGS. 1 to 3 to a sheet of drawings of the format A1 and A2.

FIG. 4 shows the folding patterns of drawings to be fed longitudinally in formats A0 and A3 respectively, while FIG. 5 shows the folding patterns of drawings to be fed transversely in the formats A1 and A2 respectively.

Numerous variations are possible within the scope of the present invention in respect of the devices shown in FIGS. 1 to 3. For example, the control of each of the devices described can be adapted to a turned-over orientation of the sheets to be supplied. Adapting the control to the supply of drawings fed with their image sides face up means that if the legends are situated at the leading edge of a supplied sheet, the leading part of the sheet is first fed between folding rollers 3 in folding station 1 and only thereafter is fed between folding rollers 4 to form the first fold, and so on. In folding station 2 the sequence of folds by folding rollers 9 and 10 is the opposite only int he case of sheets which have to be folded twice, while sheets in the formats A0 to A4 inclusive are always deposited via the different portions 20 or 23 from that for depositing a sheet of a corresponding format in accordance with the operation described hereinbefore with reference to FIGS. 1 to 3.

Each of the devices described in connection with FIGS. 1 to 3 can also be adapted to the supply of drawings to be folded, with their legends at the face-down side of the trailing edge. Irrespective of the format, this adaption requires reversing the sequence of operation of the pairs of folding rollers 3 and 4 in folding station 1, and in the case of sheets having to be folded once in folding station 2 it requires a reversal of the sequence of operation of the pairs of folding rollers 9 and 10 and a changeover in the use of portion 20 and 23 of the discharge path, and in the case of sheets which do not have to be folded or which have to be folded twice in folding station 2 it requires only a changeover in the use of portions 20 and 23 of the discharge path.

If one of the above-described folding and depositing devices is integrated with a sheet printing device, such as a copying machine, detection device 26 can be omitted and instead the format and orientation in the printing device can be established by reference to measurement of the sheets fed therein. When the printing device is a copying machine, the format and the orientation can also be derived from the format and orientation of the originals to be copied.

If one of the above-described folding and depositing devices is integrated with a copying machine in which the orientation of the image on transfer from an original to a receiving sheet can readily be turned through 90°, as in the case of an electronic copying machine in which the image is stored in an electronic memory during image transfer, it is possible for originals always to be fed uniformly in the same orientation, e.g. longitudinally, when they are scanned. In order to maintain as short a processing time as possible during printing and folding, a feature which requires transverse feed for certain formats, as explained hereinbelow, the copying machine is provided with a means known, per se, to turn the image through 90°.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A device for folding sheets of different format groups and depositing the sheets in folded form, comprising:

a first folding station for folding a sheet in a first direction an even number of times, a second folding station for folding said sheet in a second direction at right angles to said first direction, a collecting station for collecting said sheet folded by the device, a feed path for feeding said sheet to said first folding station, an intermediate transport path for conveying said sheet from said first folding station to said second folding station, and a discharge path for discharging said sheet from said second folding station to said collecting station, wherein said discharge path has a first portion for depositing in a first orientation a folded sheet belonging to a first format group, and a second portion for depositing in a second orientation a folded sheet belonging to a second format group, such that said orientations of said folded sheets are deposited in said collecting station in turned-over form with respect to one another.

2. A device according to claim 1, further including a detection means which detects format and orientation of said sheet fed in said feed path and, on the basis thereof, determines whether said sheet belongs to said first format group or said second format group, and a control means which, in response to said determination by said detection means, activates a first transport means for feeding into said first portion of said discharge path a sheet belonging to said first format group and activates a second transport means for feeding into said second portion of said discharge path a sheet belonging to said second format group.

3. A device according to claim 2, wherein said detection means classifies in the same format group a sheet whose shortest side is equal to or shorter than a maximum distance between two folds that said second folding station can accommodate and a sheet whose longest side is longer than a length of said first folding station in said second direction.

4. A device according to claim 1, wherein said first portion of said discharge path adjoins a first outlet of said second folding station and said second portion of said discharge path adjoins a second outlet of said second folding station, which outlets are situated at the ends of a transport path for conveying said folded sheet in said second folding station, said transport path being provided with first and second transport means, the direction of conveyance of said first and second transport means being reversible for selective conveyance of said folded sheet to said first outlet or said second outlet.

5. The device according to claim 4, wherein said transport path is in a vertical plane.

6. A device according to claim 1, wherein said first folding station is of the type in which a sheet is folded by two pairs of folding rollers with nips situated in one folding plane, and said intermediate transport path comprises a first path portion and a second path portion both adjoining said folding plane on a same side of said first folding station, said second path portion being provided with a transport means for feeding a sheet to said second folding station, said intermediate transport path being further provided with a guide element which can occupy two positions, a first position in which it leads a sheet from said first folding station into said first path portion and a second position in which it leads a sheet from said first folding station into said second path portion, and a control means being provided which can set said guide element only into said second position during application of a last fold in said first folding station and set said guide element into said first position during application of other folds in said first folding station.

7. The device according to claim 6, wherein said folding plane extends horizontally.

8. A device for folding sheets of different format groups and depositing the sheets in folded form, comprising:

a first folding station for folding a sheet in a first direction an even number of times, a second folding station for folding said sheet in a second direction at right angles to said first direction, a collecting station for collecting said sheet folded by the device, a feed path for feeding said sheet to said first folding station, an intermediate transport path for conveying said sheet from said first folding station to said second folding station, and a discharge path for discharging said sheet from said second folding station to said collecting station, wherein said first folding station is of the type in which a sheet is folded by two pairs of folding rollers with nips situated in one folding plane, and said intermediate transport path comprises a first path portion and a second path portion both adjoining said folding plane on a same side of said first folding station, said second path portion being provided with a transport means for feeding a sheet to said second folding station, said intermediate transport path being further provided with a guide element which can occupy two positions, a first position in which it leads a sheet from said first folding station into said first path portion and a second position in which it leads a sheet from said first folding station into said second path portion, and a control means being provided which can set said guide element only into said second position during application of a last fold in said first folding station and set said guide element into said first position during application of other folds in said first folding station.

9. The device according to claim 8, wherein said folding plane extends horizontally.

* * * * *